US006840857B2

(12) United States Patent
Ghela

(10) Patent No.: US 6,840,857 B2
(45) Date of Patent: Jan. 11, 2005

(54) LOTTERY INSURANCE METHOD

(76) Inventor: Manu Ghela, 537 S. Country Club Dr., Mesa, AZ (US) 85210

( * ) Notice: Subject to any disclaimer, the term of this patent is extended or adjusted under 35 U.S.C. 154(b) by 73 days.

(21) Appl. No.: 09/941,347

(22) Filed: Aug. 28, 2001

(65) Prior Publication Data

US 2003/0045339 A1 Mar. 6, 2003

(51) Int. Cl.[7] ..... A63F 9/24
(52) U.S. Cl. ..... 463/17
(58) Field of Search ..... 463/16–20, 25–28, 463/40–42; 705/4

(56) References Cited

U.S. PATENT DOCUMENTS

| | | | | | |
|---|---|---|---|---|---|
| 5,855,514 | A | | 1/1999 | Kamile | 463/17 |
| 5,909,875 | A | * | 6/1999 | Weingardt | 273/269 |
| 6,086,477 | A | * | 7/2000 | Walker et al. | 463/17 |
| 6,113,492 | A | | 9/2000 | Walker et al. | 463/16 |
| 6,113,493 | A | * | 9/2000 | Walker et al. | 463/25 |
| 6,117,012 | A | | 9/2000 | McCrea, Jr. | 463/27 |
| 6,254,482 | B1 | | 7/2001 | Walker et al. | 463/25 |
| 6,296,569 | B1 | * | 10/2001 | Congello, Jr. | 463/17 |
| 6,485,368 | B2 | * | 11/2002 | Jones et al. | 463/13 |

OTHER PUBLICATIONS

A Brief Explanation for Lottery Winners, Peachtree Settlement Funding, circa 1999, http://www.lumpsum.com/L_time. html.*

The Pennsylvania Bulletin, Notices: Department of Revenue: Pennsylvania Instant Million Instant Lottery Game, May 7, 1999, http://www.pabulletin.com/secure/data/vol29/29–19/759.html.*

The Pennsylvania Bulletin, Notices: Department of Revenue: Pennsylvania Tax–Free Million Instant Lottery Game, Feb, 20, 1998, http://www.pabulletin.com/secure/data/vol28/28–8/313.html.*

OnBusiness: National Date Microsite, Inflation: Main Economic Data, circa 200, http://www.onbusiness.ie.ndm/inflation.html.*

PA Lottery Information: Claiming a Prize. http://www3.palottery.com/lottery/cwp/view.asp?a=3&q=457131&lotteryNav=|29736|.*

* cited by examiner

*Primary Examiner*—Michael O'Neill
(74) *Attorney, Agent, or Firm*—Schmeiser, Olsen & Watts, LLP

(57) ABSTRACT

A method of conducting a lottery wherein lottery participants may choose to purchase insured lottery tickets is disclosed. The insurance purchased with an insured ticket guarantees that if the insured ticket turns out to be a winning ticket, the purchaser is entitled to his share of the jackpot immediately, rather than being forced to accept a smaller amount immediately or the full amount in installments over time. In a particular embodiment, insurance may be purchased that guarantees a winner will immediately be paid, in addition to his share of the jackpot, an additional amount equal to at least a portion of the income or other taxes payable on the jackpot.

11 Claims, 3 Drawing Sheets

LOTTERY INSURANCE METHOD

BACKGROUND OF THE INVENTION

1. Technical Field

This invention generally relates to lotteries, and more specifically relates to insurance sold in connection with lottery tickets.

2. Background Art

A lottery, in a broad sense, is a way of distributing prizes, including monetary awards, by chance or luck. One popular lottery format requires participants to risk a relatively small amount of money, often by purchasing a lottery ticket, in exchange for the chance to win a much larger sum of money. Conventional lottery tickets are associated with combinations of numbers, either pre-selected or chosen at the time of purchase, and winning tickets are those whose number combinations either completely or partially match a winning number combination. Tickets with complete matches are conventionally awarded a much larger prize than are tickets with partial matches. The maximum prize awarded for a completely matching number combination is often referred to as a jackpot. In this description of the invention, however, the word "jackpot" means any prize above a cutoff point, as defined below.

It is conventional for lottery operators to award a jackpot to a lottery winner only if the winner is willing to accept multiple installment payments consisting of portions of the total payout over a payout period. Payout periods of 20 or 25 years are not uncommon. If the jackpot winner elects not to receive installment payments, the only conventionally available alternative is to receive a lump sum payment immediately upon winning, where the lump sum payment is significantly less than the jackpot. This may be referred to as selecting a cash option. It is not unusual for the lump sum payment immediately available to jackpot winners-the cash option-to be no greater than half or roughly half of the jackpot amount. As used herein, the word "immediately," when used to describe the timing for payment of lottery winnings, means within a reasonably short time, e.g., a few days, weeks or months, after a winning lottery ticket is identified.

It will be readily apparent to one of ordinary skill in the art that winners of certain non-jackpot prizes in a conventional lottery may be awarded their full prize amount immediately upon winning. The value of prizes immediately awarded in full may vary from one lottery to another, with $100,000 being considered a conventional cutoff point: prizes below that amount may conventionally be immediately paid in full; prizes above that amount may conventionally be subject to the cash option reduction. In this description of the invention, a "large payout" is one whose value is above a cutoff point, which may be $100,000 but may also be any other amount above which the lottery operators are not willing to immediately proffer full payment. A "small payout" is one whose value is below a cutoff point. The jackpot, by definition herein, is a large payout, i.e., is above the cutoff point for a particular lottery and is subject to the cash option reduction. It is to large payouts that the present invention particularly applies, and the phrase "winning ticket" herein means a ticket which is entitled to the jackpot or other large payout. The phrase "paying ticket" means a ticket that is entitled to some payout, without regard to whether it is large or small.

Regardless of the payout method selected by a lottery winner, taxes on the winnings may reduce the amount a winner actually realizes. Furthermore, if more than one lottery participant holds a ticket having the winning number combination in a conventional lottery, the amount a winner realizes is further diminished, because the total jackpot stays constant no matter how many winners there are. Whatever the reason for them, such reductions in realized prize money are upsetting to many lottery participants who find themselves with less money than they were anticipating when they purchased a ticket. Even if the lump sum distribution rules are known in advance to the lottery participants, many winners still experience disappointment at not receiving the full jackpot immediately upon winning.

Existing lottery methods address other sources of potential disappointment on the part of lottery winners. In one method, lottery participants bet that they will not select a winning number combination, but may wager an additional amount to ensure that if they do select a complete winning combination they will still be granted a prize as if they had wagered to win rather than lose. In another method, lottery participants may pay extra for the right to keep playing a lottery even after an event that would otherwise knock them out of the game. In still another method, lottery players may pay an additional amount to purchase a "never-lose" ticket that remains valid until it wins something, whether it be the jackpot or some smaller prize. None of the existing methods or inventions, however, address the issue of the inability of a lottery winner to immediately collect their share of the jackpot associated with winning a lottery.

SUMMARY OF THE INVENTION

Therefore, there exists a need for a method of operating a lottery that allows lottery participants to collect their share of the jackpot immediately upon winning it. The present invention fills that need by providing a method of conducting a lottery wherein lottery participants may choose to purchase insured tickets. The insurance purchased with an insured ticket guarantees that even if the insured ticket is a large-payout winning ticket, the purchaser is entitled to the jackpot or other large payout, as applicable, immediately, rather than being forced to accept a smaller amount up front or the full amount in installments over time. As has been previously mentioned, in this description of the invention, the word "jackpot" may in various places represent any large payout, i.e., any prize too large to be available for immediate payment in full. In a particular embodiment, insurance may be purchased that guarantees a winner will immediately be paid, in addition to his share of the jackpot, an additional amount equal to at least a portion of the income taxes or other taxes payable on the jackpot.

The present invention addresses potential disappointment on the part of a lottery winner in regard to the collection of prize money. The invention also provides an avenue for lottery operators to offer an additional service to lottery participants in return for increased revenue. The invention may also encourage participation in the lottery by some players who would not participate in a conventional lottery, thus further increasing revenue.

BRIEF DESCRIPTION OF THE DRAWINGS

The foregoing and other features and advantages of the invention will be apparent from the following more particular description of specific embodiments of the invention, as illustrated in the accompanying drawings, wherein.

DETAILED DESCRIPTION OF EMBODIMENTS OF THE INVENTION

Figure 1:
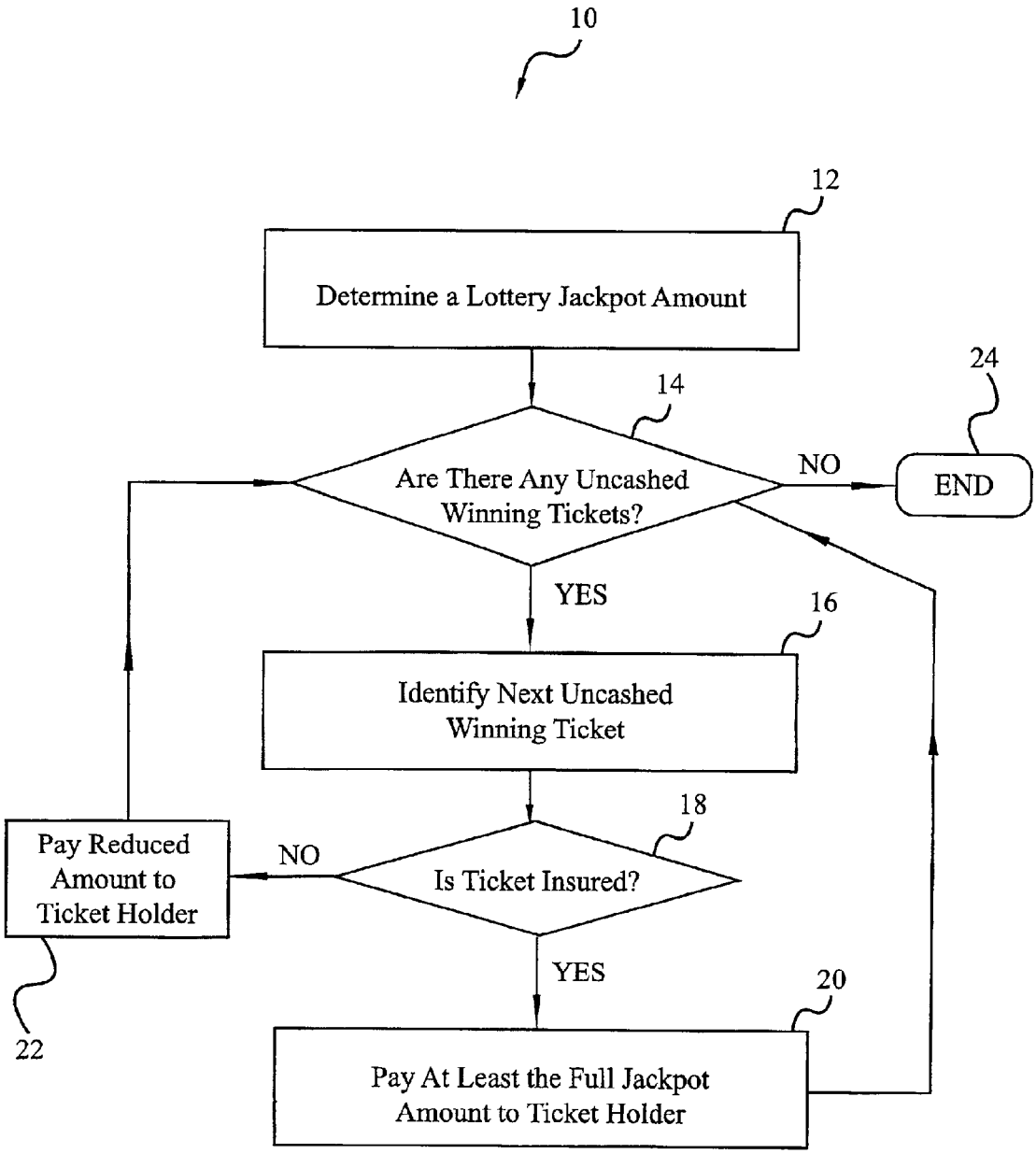
FIG. 1 is a flow chart illustrating a method of conducting a lottery according to an embodiment of the present invention.

Referring now to the figures, and in particular to FIG. 1, a method 10 of conducting a lottery according to the present invention includes steps 12 through 24. In a first step 12, a lottery jackpot is determined. The ways in which this may be done are well known in the art. Both fixed jackpots and increasing jackpots are common. Often, the award amounts are arbitrarily selected to be round numbers, e.g. five million, but amounts of any size, chosen upon any basis, are possible.

It is conventional, for example, to select an arbitrary, fixed jackpot, perhaps five million dollars, that is large enough to attract interest in the lottery. After a period set aside for ticket sales, a winning number combination is selected, perhaps by a random number generator, by a hand drawing, or some other method known in the art. A winning number combination may also have been secretly selected at some earlier time. If a lottery participant has a ticket with a winning combination, the jackpot may be presented to that participant. If no one has chosen the winning combination, the lottery may conclude with no prize awarded. Alternatively, the jackpot may be rolled over into a new lottery and further ticket sales may be conducted towards a future lottery with the same or an increased jackpot.

In a second step 14, it is determined whether there are any winning lottery tickets that have not yet been cashed. An uncashed ticket is one that has not yet received any payout amount it is entitled to. Generally, the lottery operators designate a period of time during which winning and other paying tickets may be cashed, and beyond which all tickets are void. If, during the eligibility period, there are such uncashed tickets, the process continues to a third step 16, where the next uncashed winning ticket is identified. If no uncashed winning ticket exists, or if the eligibility period expires, the process proceeds to a final step 24, and concludes. In some instances, this concluding outcome will occur because no lottery participant has selected a winning number combination, and there will thus be no winning ticket at all. In other instances the outcome will occur because all winning tickets, whether one or more than one, have been cashed and the prize money paid in an earlier iteration of process 10. In still other instances, one or more paying tickets may not be cashed at all.

A lottery ticket is a paying ticket if it reflects a winning number combination determined by the lottery operator. As will be more fully explained in connection with FIGS. 2 and 3, the winning combination may be a series of numbers, perhaps in a particular order. In some lotteries it is conventional for lottery tickets having some but not all of the winning numbers to be eligible for prizes in amounts less than the jackpot. These lesser amounts may be either large or small payouts, as defined herein.

In a next step 18, it is determined whether the next uncashed winning ticket identified in step 16 has been insured. This insurance will be discussed in greater detail in connection with FIG. 2. For at least those winners with non-insured tickets, all winning tickets must be collected or the eligibility period must end before the reduced prize amount for each winner can be determined. If the ticket is insured, a step 20 is reached, wherein the ticket holder is immediately paid at least his share of the jackpot determined in step 12, based upon the insurance purchased: the jackpot if the ticket is payout insured; the jackpot plus an additional amount representing at least a portion of the taxes payable on the jackpot if the ticket is tax insured. In this description of the invention, the word "immediately," when used to describe the timing for payment of lottery winnings, means within a reasonably short time, e.g., a few days, weeks or months, after a winning lottery ticket is identified.

If the ticket is not insured, step 20 is bypassed in favor of a step 22. Thereupon, a reduced amount is paid to the holder of the ticket. The reduced amount is less than the jackpot, and may be, for example, approximately half of the full jackpot. Steps 20 and 22 lead back to step 14, from which point the process either terminates or continues through another iteration, until all winning tickets are cashed.

Figure 2:
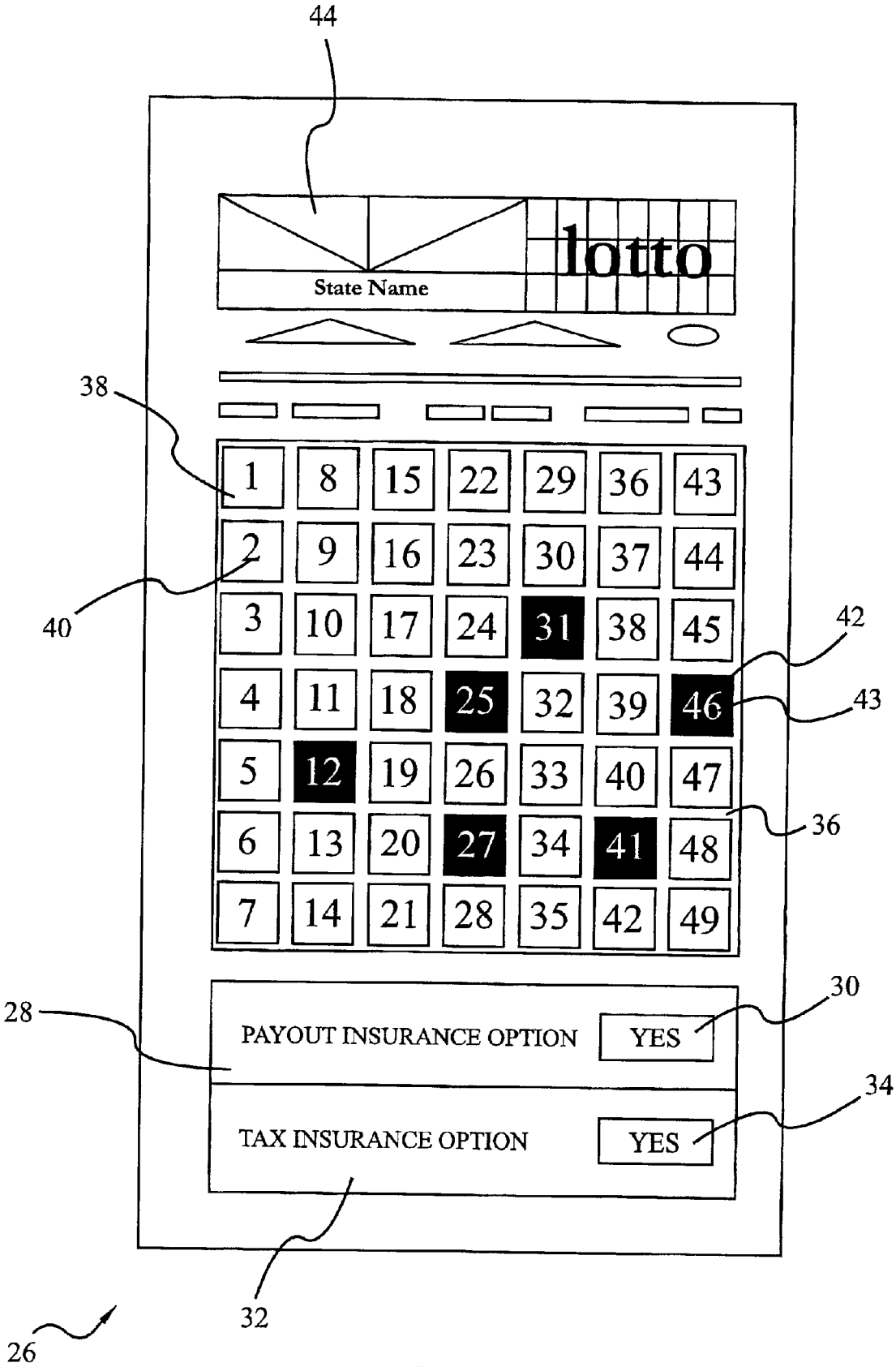
FIG. 2 is a view of a lottery option selection sheet configured according to an embodiment of the present invention.

Referring now to FIG. 2, a lottery option selection sheet 26 includes a payout insurance option region 28 and a tax insurance option region 32. A yes box 30 is associated with region 28 and a yes box 34 is associated with region 32. A lottery participant, after obtaining a lottery option selection sheet 26, may elect to purchase payout insurance by so indicating in box 30. The indication may be made by initialing in box 30, by darkening it or filing it in, or by some other act.

According to the present invention, the payout insurance that may be offered for sale in connection with lottery option selection sheet 26 may guarantee to the insurance purchaser that in the event he holds a winning ticket, he will immediately be paid his share of the jackpot. In existing lotteries, winning participants cannot immediately collect their share of the jackpot because lottery operators offer lottery winners a choice between only two options: receiving the jackpot in partial payments spread out over time; or receiving an immediate payment in a reduced amount totaling much less than the jackpot. Conventionally, the partial payments are spread out over a payout period consisting of many years, with 20- and 25-year payout periods being common, and the reduced amount available for immediate payment is conventionally only half the jackpot. This lottery operating method may spark disappointment, frustration, or anger in lottery winners, and may discourage potential lottery participants from participating in the lottery at all.

Conventionally, lottery payout amounts remain constant regardless of the number of lottery participants who select the associated winning number combination. Not every lottery or every prize will have multiple winners, of course, but those that do cause each such prize to be split among each winner, thus reducing the amount each winner receives. In one embodiment of the present invention, the price of payout insurance may be adjusted so as to allow the lottery operators to immediately pay the full amount of a prize, whether a large payout or a small payout, to each winner of such large or small payout, regardless of the number of such winners.

A further source of potential disappointment for lottery winners is the prospect of paying taxes on the winnings. To mitigate this eventuality, a lottery participant may select tax insurance by so indicating in box 34 of tax insurance option region 32. The purchase of tax insurance guarantees that a lottery winner will immediately be paid his share of the jackpot plus an additional amount that represents at least a portion of the taxes payable on the jackpot. This amount may be any portion at all, but in one embodiment may be sufficient to pay all or significantly all Federal income taxes due on their jackpot winnings. In another embodiment it may be sufficient to pay all or significantly all Federal and State income taxes, and in other embodiments it could be half of all Federal income taxes, or of all Federal and State taxes of any kind. Other portions or percentages of these or other kinds of taxes are also possible.

The phrase "tax insured lottery ticket" herein means a lottery ticket that carries both tax insurance and payout insurance. It should be understood, however, that in at least one embodiment of the invention, tax insurance may be purchased separate from payout insurance. The phrase "insured lottery ticket" means a lottery ticket for which at least one form of either tax insurance or payout insurance has been purchased.

The lottery insurance method of the present invention may be used in connection with lotteries of any kind, without regard to the specific manner of selecting options, such as insurance type and number combinations, or to other lottery details such as jackpot size, total ticket sales, frequency or method of determining a winning number combination, or any other lottery detail. Referring still to FIG. 2, certain details and procedures conventional to lotteries will be described, by way of illustration and not of limitation. A number region 36 contains a plurality of number boxes 38. Each number box 38 contains a playing symbol 40. In one embodiment, playing symbol 40 may be a whole number between 1 and 49. In other embodiments, different numbers, different symbols, or different numbers of symbols, are possible. A selected number box 42 contains a selected playing symbol 43 that has been chosen by a lottery participant as part of a number combination. In the illustrated embodiment, there are six selected number boxes, each containing one selected playing symbol 43. In other embodiments, more or fewer boxes may be selected. An information region 44 may contain information about the lottery operator, such as the name of a particular state, along with any other information relative to the lottery.

Figure 3:
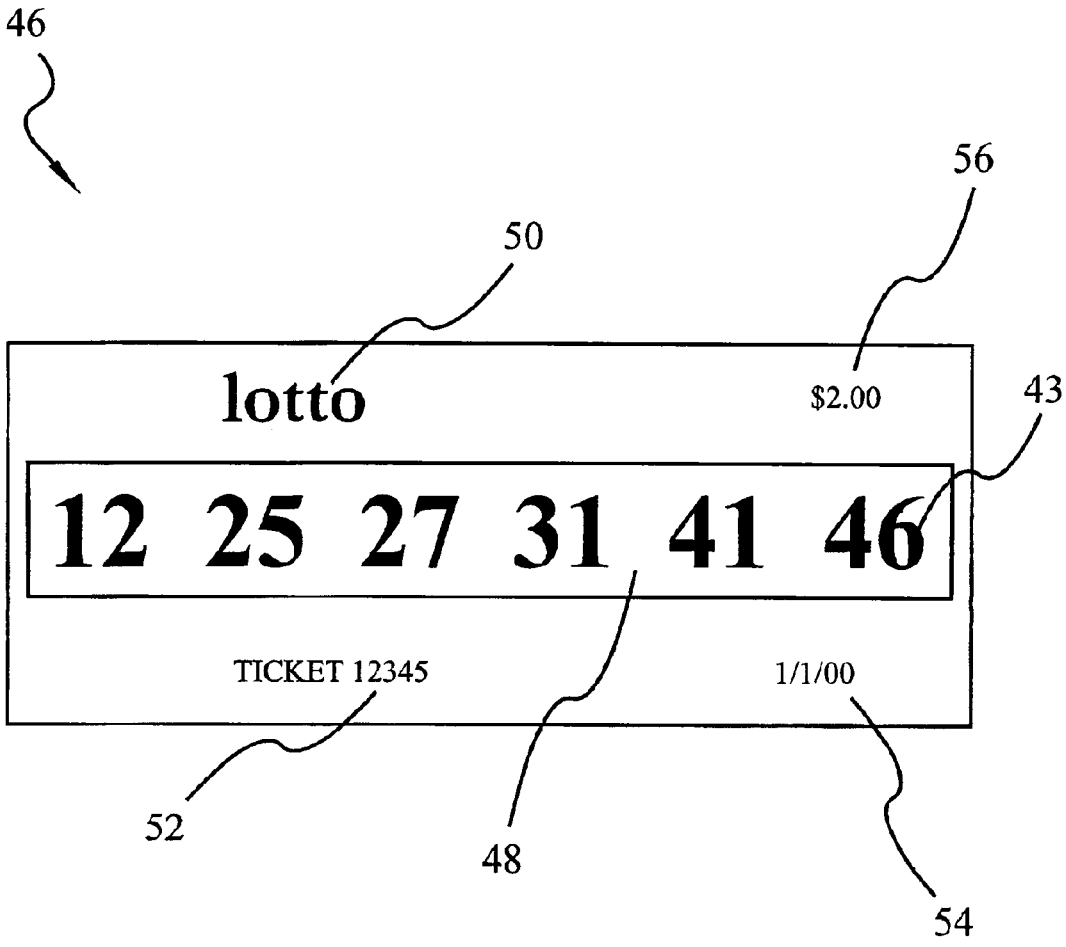
FIG. 3 is a view of a lottery ticket configured according to an embodiment of the present invention.

After a lottery participant makes use of lottery option selection sheet 26 to select an appropriate number of playing symbols 40, and to indicate whether insurance is desired, and of what type, lottery option selection sheet 26 may be returned to a vendor with payment in exchange for a lottery ticket 46 (see FIG. 3). The amount of the payment required may depend in part on the options selected. It may also depend on other factors such as vendor location, the level of public interest in the lottery, the projected number of lottery participants, and other factors. Alternatively, an electronic equivalent of lottery option selection sheet 26 may be used to collect similar information and automatically calculate the payment amount. The price of lottery ticket 46, and how it may be determined, will be further discussed in connection with FIG. 3.

A vendor to which lottery option selection sheet 26 is presented may obtain therefrom the information needed to create lottery ticket 46 in any one of a number of ways. For example, the vendor could visually scan lottery option selection sheet 26 in order to figure out what options and playing symbols 40 have been selected, then transform that information into a format readable by a computer or printer which would then generate lottery ticket 46. Alternatively, a scanning device could read lottery option selection sheet 26 and then transmit the relevant information to a printer for creation of lottery ticket 46. Other options for obtaining information from lottery option selection sheet 26 may also be available, as will be readily apparent to one of ordinary skill in the art.

In FIG. 3, lottery ticket 46 contains a number combination 48 made up of selected playing symbols 43. In the illustrated embodiment, number combination 48 includes six selected playing symbols 43, but in other embodiments more or fewer selected playing symbols 43 may be used. At a time determined by the lottery operators, a winning number combination may be determined, in one or another manner well known to those of ordinary skill in the art, after which time the holder of lottery ticket 46 may compare number combination 48 to the winning number combination. If a required number of selected playing symbols 43 match a playing symbol included in the winning number combination, lottery ticket 46 is a winning lottery ticket, and may be presented to the lottery operators in return for payment of the appropriate prize amount.

Lottery ticket 46 may further contain an identifier 50, a ticket number 52, a date 54, and a price 56. Identifier 50 may convey various types of information about lottery ticket 46, or about the lottery it represents. Identifier 50 may, for example, convey information about the identity of the lottery operator, but any other type of information is also possible. Ticket number 52 may serve, for example, to distinguish lottery ticket 46 from all other existing lottery tickets, or from all other lottery tickets sold in conjunction with a particular lottery, or within a particular period. Ticket number 52 may thus comprise a number alone, a number combined with letters or other symbols, or some other distinguishable group of characters. Date 54 may indicate the date on which lottery ticket 46 was purchased, the date on which the winning number combination is to be determined, the date by which a winning lottery ticket must be cashed, or any other applicable date. Price 56 may indicate the price paid for lottery ticket 46, and may also indicate whether payout insurance or tax insurance has been purchased for lottery ticket 46, as will be further described below.

Price 56 for lottery ticket 46 may be determined in accordance with any known pricing method. Such pricing methods may take into account the projected number of lottery tickets that will be sold in a given period, the projected number of lottery participants that will purchase payout insurance or tax insurance, the jackpot, and other factors. One pricing method is set forth in U.S. Pat. No. 6,086,477, entitled METHODS AND APPARATUS WHEREIN A LOTTERY ENTRY IS ENTERED INTO LOTTERY DRAWINGS UNTIL THE LOTTERY ENTRY IS IDENTIFIED AS A WINNER, issued Jul. 11, 2000 to Walker et al., and which is incorporated herein by reference. Other pricing methods may also exist, and any pricing method now known or developed in the future is a possible method appropriate for use in connection with the present invention.

Price 56 may be observed by a lottery participant, a vendor, a lottery operator, or other person in order to determine whether payout insurance or tax insurance has been purchased in connection with lottery ticket 46. For example, the prices of a non-insured, a payout insured, and a tax insured lottery ticket may be known to the observer of lottery ticket 46. By comparing price 56 to the known prices for each type of ticket, the insurance status of lottery ticket 46 may be easily determined. In some embodiments of the present invention, the type of insurance, if any, purchased with lottery ticket 46 may be determined in some other way. For example, lottery ticket 46 may be marked or altered in some recognizable way corresponding to the insurance purchased. This could entail a physical marking of the ticket, perhaps with ink or another permanent substance, the storing of ticket number 52 in a database for future retrieval, the sale of tickets wherein different sizes, colors, shapes, or other characteristics correspond to a particular insurance level, or some other method.

In one embodiment of the invention, a non-insured lottery ticket may be upgraded to an payout insured lottery ticket by paying a first upgrade price. This may be referred to as a payout insurance upgrade. Similarly, a payout insured ticket may be upgraded to a tax insured ticket by paying a second upgrade price. This may be referred to as a tax insurance upgrade. Such upgrades may, in one embodiment, be made until a cutoff time, where the cutoff time may precede the time at which the winning number combination is determined. In one embodiment, the first upgrade price is equal to the difference between the price of a non-insured and a payout insured ticket, while the second upgrade price is equal to the difference between a payout insured and a tax insured ticket. In another embodiment, the first and second upgrade prices may increase as the cutoff time approaches. In other embodiments, some other pricing scheme may apply.

The foregoing description has described selected embodiments of a method of conducting a lottery wherein lottery participants may choose to purchase insured lottery tickets. The insurance purchased with a payout insured ticket guarantees that if the payout insured ticket turns out to be a winning ticket, the purchaser is entitled to his share of the full jackpot immediately, rather than being forced to accept either a smaller amount immediately or the jackpot in installments over time. In a particular embodiment, tax insurance may be purchased that guarantees a winner will immediately be paid, in addition to his share of the jackpot, an additional amount equal to at least a portion of the income or other taxes payable on the jackpot.

While the invention has been particularly shown and described with reference to selected embodiments thereof, it will be readily understood by one of ordinary skill in the art that, as limited only by the appended claims, various changes in form and details may be made therein without departing from the spirit and scope of the invention.

I claim:

1. A method of conducting a lottery comprising the steps of:

(1) determining a cutoff point for said lottery, said cutoff point comprising a prize value amount separating a large payout amount from a small payout amount, wherein said large payout amount is an amount payable in full to non-payout insured, winning ticket purchasers by way of payments paid during a payment period lasting longer than one year, and wherein said small payout amount is an amount payable in full in a single lump sum payment;

(2) immediately paying in full said small payout amount to a winner of said small payout amount;

(3) immediately paying in full said large payout amount to a payout insured winning ticket purchaser; and (4) immediately paying an amount equal to at least a portion of the winning ticket purchaser's taxes due to a purchaser of a tax insured winning ticket.

2. A method of conducting a lottery comprising the steps of:

(1) distributing lottery tickets to lottery participants for a lottery game, said tickets including tax insured tickets and non-tax insured tickets;

(2) determining whether a particular ticket is a paying ticket for the lottery game;

(3) paying the award amount plus an additional amount equal to at least a portion of the taxes payable on the award amount if the paying ticket is tax insured;

(4) paying the award amount without an additional amount for taxes if the paying ticket is non-tax insured; and (5) immediately paying at least the full award amount if the paying ticket is payout insured, regardless of the award amount.

3. A method of conducting a lottery comprising the steps of:

(1) selling payout-insured and non-payout insured lottery tickets for a lottery game in which ticket purchasers select at least one number combination for each lottery ticket purchased and for which a prize cutoff point is established, said cutoff point comprising a prize value amount separating a large payout amount from a small payout amount, wherein said large payout amount is an amount payable in full to non-payout insured, winning ticket purchasers by way of payments paid during a payment period lasting longer than one year, and wherein said small payout amount is an amount payable in full in a single lump sum payment;

(2) immediately paying in full to a holder of a payout-insured paying lottery ticket regardless of whether the paying lottery ticket is entitled to a large payout amount or a small payout amount;

(3) selling tax-insured and non-tax insured lottery tickets for the lottery game;

(4) awarding to a holder of a tax-insured paying ticket an amount equal to the prize amount plus an amount equal to at least a portion of the taxes for the prize; and (5) awarding to a holder of a non-tax-insured paying ticket an amount equal to the prize amount without any additional amount for taxes.

4. The method of claim 3, wherein the full award amount is paid to the holder of the payout-insured paying lottery ticket regardless of the number of participants in the lottery.

5. The method of claim 3, wherein purchasers select at least one number combination for each lottery ticket purchased.

6. The method of claim 3, further including the step of offering a payout insurance upgrade for sale at a payout insurance upgrade price to a purchaser of a non-insured lottery ticket, said payout insurance upgrade converting said non-insured lottery ticket to a payout insured lottery ticket.

7. The method of claim 3, further including the step of offering a tax insurance upgrade for sale at a tax insurance upgrade price to a purchaser of a payout insured lottery ticket, said tax insurance upgrade converting said payout insured lottery ticket to a tax and payout insured lottery ticket.

8. The method of claim 3, further including the step of offering a tax insurance upgrade for sale at a tax insurance upgrade price to a purchaser of a non-tax insured lottery ticket, said tax insurance upgrade converting said non-tax insured lottery ticket to a tax insured lottery ticket.

9. A method of conducting a lottery comprising the steps of:

(1) distributing lottery tickets to lottery participants for a lottery game, said tickets including tax insured tickets and non-tax insured tickets;

(2) determining whether a particular ticket is a paying ticket for the lottery game;

(3) paying the award amount plus an additional amount equal to at least a portion of the taxes payable on the award amount if the paying ticket is tax insured;

(4) paying the award amount without an additional amount for taxes if the paying ticket is non-tax insured; and (5) offering a payout insurance upgrade for sale at a payout insurance upgrade price to a purchaser of a non-tax insured lottery ticket, said payout insurance upgrade converting said non-tax insured lottery ticket to a payout insured lottery ticket.

10. A method of conducting a lottery comprising the steps of:

(1) distributing lottery tickets to lottery participants for a lottery game, said tickets including tax insured tickets and non-tax insured tickets;

(2) determining whether a particular ticket is a paying ticket for the lottery game;

(3) paying the award amount plus an additional amount equal to at least a portion of the taxes payable on the award amount if the paying ticket is tax insured;

(4) paying the award amount without an additional amount for taxes if the paying ticket is non-tax insured; and (5) offering a payout insurance upgrade for sale at a payout insurance upgrade price to a purchaser of a tax insured lottery ticket, said payout insurance upgrade converting said tax insured lottery ticket to a tax and payout insured lottery ticket.

11. The method of claim 2, further including the step of offering a tax insurance upgrade for sale at a tax insurance upgrade price to a purchaser of a non-tax insured lottery ticket, said tax insurance upgrade converting said non-tax insured lottery ticket to a tax insured lottery ticket.

* * * * *